US006154882A

United States Patent [19]

Ullman

[11] Patent Number: 6,154,882

[45] **Date of Patent: *Dec. 5, 2000**

[54] PROTECTION DEVICE PREFERABLY FOR USE IN A GLOVE

[76] Inventor: Johan Ullman, Johannebergsgatan 32B, S-412 55 Göteborg, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/875,880

[22] PCT Filed: Feb. 8, 1996

[86] PCT No.: PCT/SE96/00061

§ 371 Date: Nov. 8, 1997

§ 102(e) Date: Nov. 18, 1997

[87] PCT Pub. No.: WO96/24410

PCT Pub. Date: Aug. 15, 1996

[30] Foreign Application Priority Data

Feb. 9, 1995 [SE] Sweden ..... 9500506

[51] Int. Cl.[7] ..... A41D 19/00

[52] U.S. Cl. ..... 2/20; 2/160; 2/161.1

[58] Field of Search ..... 2/16, 159, 160, 2/161.1, 20

[56] References Cited

U.S. PATENT DOCUMENTS 4,011,596 3/1977 Chang .
4,400,831 8/1983 Rietz .
5,353,440 10/1994 Meldeau .
5,870,773 2/1999 Smith ..... 2/16
5,930,835 8/1999 Silvestri ..... 2/16

OTHER PUBLICATIONS

Derwent's Abstract, No. 88–329217/46, week 8846, Abstract of SU, 1395346 (Phys Culture Inst), May 15, 1988.

*Primary Examiner*—Michael A. Neas
*Attorney, Agent, or Firm*—Lerner, David, Littenberg, Krumholz & Mentlik, LLP

[57] ABSTRACT

The invention relates to a protection device intended for reducing the risk and effect of hand and arm injuries during, for example, sporting activities. The protection device comprises a gripping element (2) arranged to be placed at the palmar side of the hand in such a way that at least some of the fingers of the hand can optionally be closed around the gripping element (2) or alternatively be opened and release the grip about the gripping element (2), that the gripping element (2) is so shaped and placed in the hand that the user is influenced to clench the hand around it when, for example, falling and that the gripping element (2) is formed to allow good freedom of movement for the hand so that desired articles can be gripped.

22 Claims, 9 Drawing Sheets

PROTECTION DEVICE PREFERABLY FOR USE IN A GLOVE

INTRODUCTION

The invention relates to a protection device intended for reduction of the risk and the effect of hand and arm injuries, for example during sporting activities. The protection device is intended to influence the behaviour of the user to make him clench the hand when falling, but during normal use nevertheless allow the hand and its fingers a great freedom of movement to grip articles such as ski poles, snowboards, skateboards and similar equipment.

BACKGROUND

When performing different kinds of sports, for example snowboarding, skateboarding, skiing, cycling, motorcycling, etc., it is not unusual that the practiser is subjected to accidents resulting in fractures of the bones in the forearm or in the hand. The reason for this is often that the practiser, for example during a fall, as a reflex opens his hand and perhaps stretches his fingers out to break his fall with the flat of the hand. The hand and/or the fingers will thereby form relatively long lever arms and are easily broken by heavy impacts. Even if the hand is clenched on the fall and the person strikes the ground with the hand clenched, injuries can arise resulting in joint and skeletal injuries in the hand or the fingers. The reason is that the cavity which is formed within the hand when it is clenched allows the fingers, on external pressure, to be displaced further in against the centre of the clenched hand.

PRIOR ART

It is usual nowadays that gloves intended for use in the exercise of winter sports are lined for better heat insulation. However, gloves are also sometimes provided with stuffing at the outer side of the hand and/or the fingers with the aim of dampening impacts and minimising the risk of injury. Such gloves are, on the other hand, often stiff and cumbersome and even cause the user to keep the hand open if a near accident happens, which accordingly can give rise to serious consequences. There are even examples of gloves where strips of a stiff material are inserted in the glove to stabilise the wrist. In unfortunate circumstances, these strips can increase the injuries instead of reducing them.

THE OBJECT OF THE INVENTION AND ITS MOST IMPORTANT FEATURES

The object of the present invention is to show a protection device preferably for use in or together with a glove and which reduces the risk and the consequence of an injury, for example by a fall, by changing the behaviour of the user. The protection device shall be so formed that when being used it also allows good mobility of the hand so that the intended sport or activity can be performed without any hindrance.

Further objects are, by the shape of the protection device and the glove, to cause the muscles of the forearm to contract in an advantageous way when the person falls, to obtain optimal superposing of actin and myosin fibrils thereby increasing the strength of the skeleton and that the hand automatically resumes its unbent normal position (such as is shown in FIG. 14). The strength of the bone tissue of the forearm and the hand can in this way be increased up to 10 times. The risk of injuries to the forearm, the wrist, the small bones of the hand or the fingers is hereby reduced substantially.

A further object of the invention is, by the protection device and the construction of the glove, to bring about an extension of the forearm to reduce the consequences of the injuries to the lower part of the back when the person falls backward. By influencing/teaching the user to clench the hand, i.e. to make a "clenching reflex", the arm will in practice be extended by 5–10 cm (most often about 7 cm) compared with if it is open and dorsally inflected (see FIG. 21) and the arm/hand reaches the ground earlier than what is the case with an open hand. Further, a clenched hand will decrease the risk that fingers are forced down into and become stuck in hard snow. This is today a common cause of injuries.

Another object is to distribute the forces that hit the hand locally to the other parts of the hand.

According to the invention, the objects are obtained in that the protection device comprises a gripping element 2 arranged to be located at the palmar side of the hand in such a way that at least some of the fingers optionally can be closed around the gripping element 2, or alternatively can be opened and release the grip on the gripping element 2, in that the gripping element 2 is so shaped and so located in the hand that it is natural for the user to clench the hand around it, for example when falling, and in that the gripping element 2 is so shaped that when it is squeezed in the hand the pressure between the gripping element 2 and the hand will be approximately the same around the whole gripping element 2. The gripping element 2 is also shaped to allow a great freedom of movement for the hand and its fingers so that any desired articles can be gripped.

DESCRIPTION OF THE DRAWINGS

The invention will be further described with reference to the attached drawings where.

DESCRIPTIONS OF EMBODIMENT EXAMPLES

Figure 1:
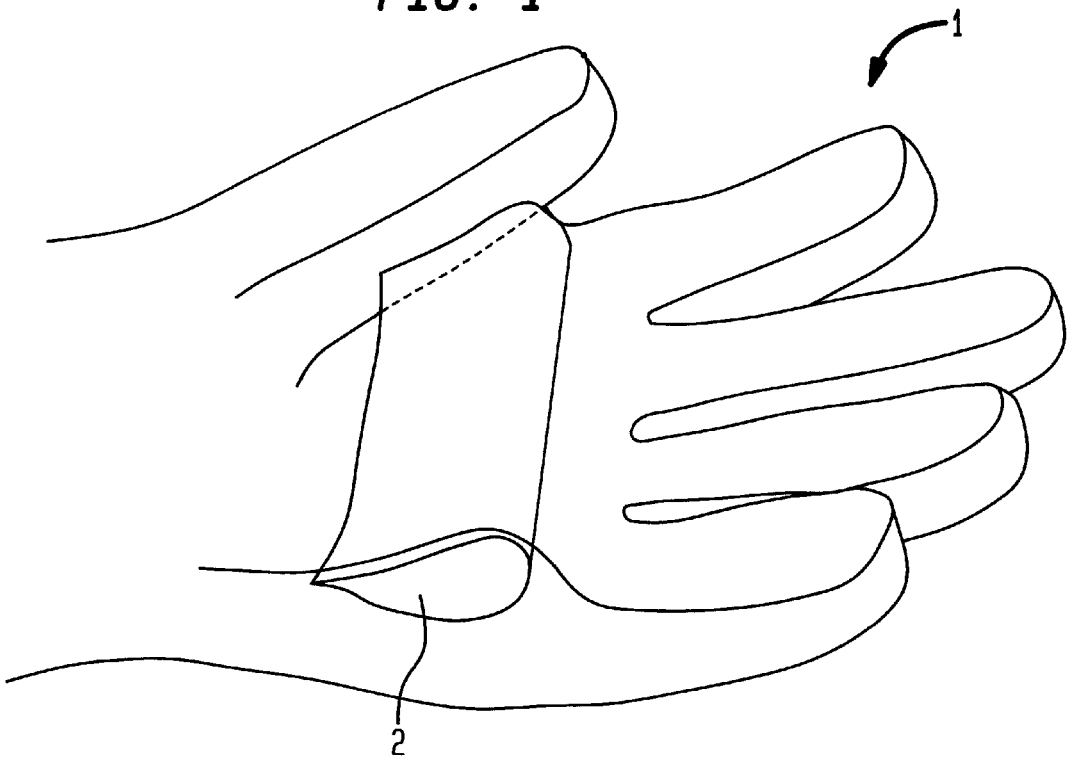
FIG. 1 shows a protection device according to the invention in the shape of a drop-shaped gripping element located in a glove at its palmar side.

An embodiment of the invention is shown in FIG. 1 and consists of a glove 1 which can be made from leather or from artificial materials known per se. In the so-called flat or palmar part of the hand/glove a protection device according to the invention is located, which preferably is a grip-friendly article or a so-called gripping element 2. This can be placed so that it abuts against the flat of the user's hand (the palmar side of the hand) or at least is situated near the flat of the hand when the glove is used. This will give the user of the glove a feeling that he has an article in his hand so that the user will learn to close the hand reflexively and automatically if he falls. The fingers are fixed and stabilised in relation to each other, the lever effect of the hand and its fingers is reduced or eliminated and the possible impact or stresses against a part of the hand/glove are distributed between the fingers and the wrist. The risk of injuries is thereby reduced substantially. By means of the user clenching the hand firmly before it hits the ground, the hand will, by the cooperative influence of the flexor and extensor muscles, automatically come with its centre in the extension of the underarm. The space within the hand, i.e. inside the closed fingers, is also filled up by the gripping element 2 which accordingly decreases the risk of fractures to the fingers.

By dimensioning the gripping element 2 so that the muscles in the forearm, when they are tensioned to grip around the gripping element 2, will obtain an optimal superposing between the actin and myosin fibrils, the tension which the muscles exert on the bone will be greater than if the hand was clenched without the gripping element 2. At normal muscle tension the strength of the bone may increase up to 10 times.

The gripping element 2 is placed in the glove, for example in a pocket which has been arranged therein, for example sewn (not shown), and it is produced of an at least to some extent flexible resilient or damping material such as rubber, neoprene or cellular plastics. The gripping element 2 can of course also be produced of a hard material such as plastics, wood or the like but in such a case it may advantageously be provided with a softer surface layer. The gripping element 2 in the shown embodiment example has a drop-shaped cross section but it can also be formed in other ways which will be shown below.

Figure 2:
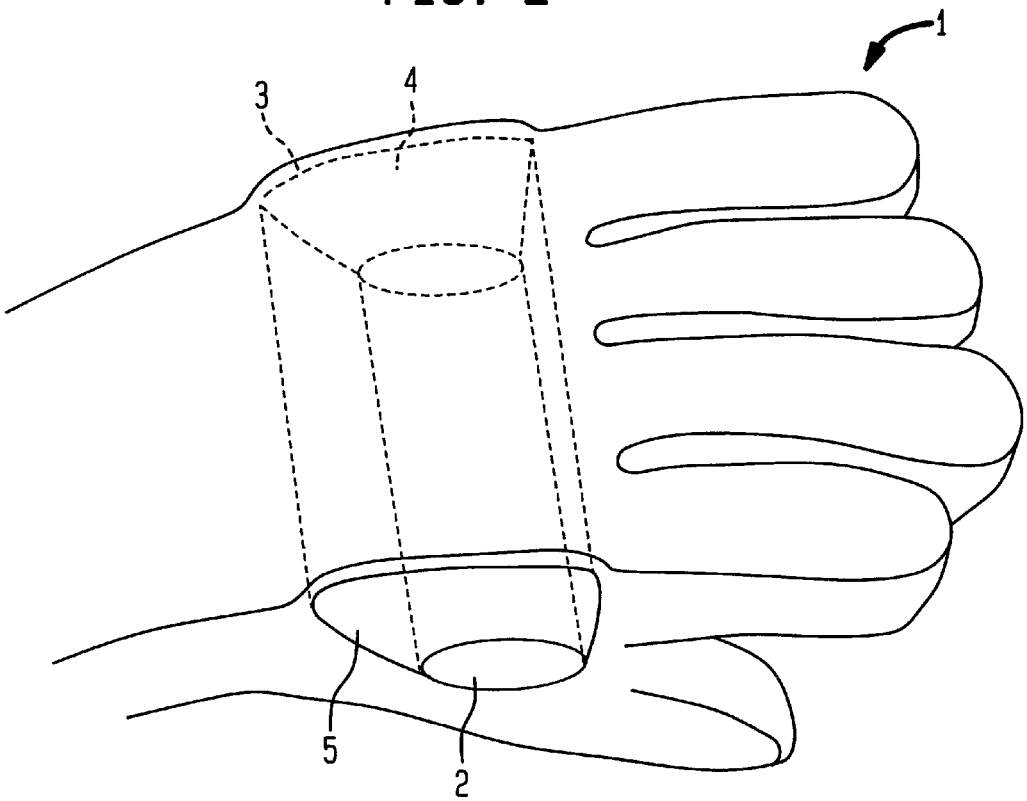
FIG. 2 shows a glove provided with a tube-shaped gripping element connected by side supports with a protection element located on the outer side of the hand or the glove, a so-called knuckle protector.

An alternative embodiment of the protection device is shown in FIG. 2 where the gripping element 2 consists of a hollow body of a hard or somewhat bendable material. The advantage of a hollow gripping element 2 is that the weight is lowered at the same time as sufficient material and "squeezing resistance" nevertheless can be obtained. Another advantage of this embodiment is that different degrees of compression can be allowed, which increases the comfort of the user. The glove shown in FIG. 2 has also been provided with a protection 3 arranged at the outer side of the hand, a so-called knuckle protector. This is connected to a side support 4 made from a substantially unbendable material such as cured plastic, composite material (for example, glass fibre-reinforced polymer) or a metal. The gripping element 2, the knuckle protector 3 and the side support 4 thus constitute an integrated unit and its function is inter alia to relieve the pressure of local impacts from, for instance, the fingers or the little finger side of the hand (the ulnar side) and distribute these forces (inter alia to the wrist). In this way, further risk of bone fracture is reduced.

Figure 3:
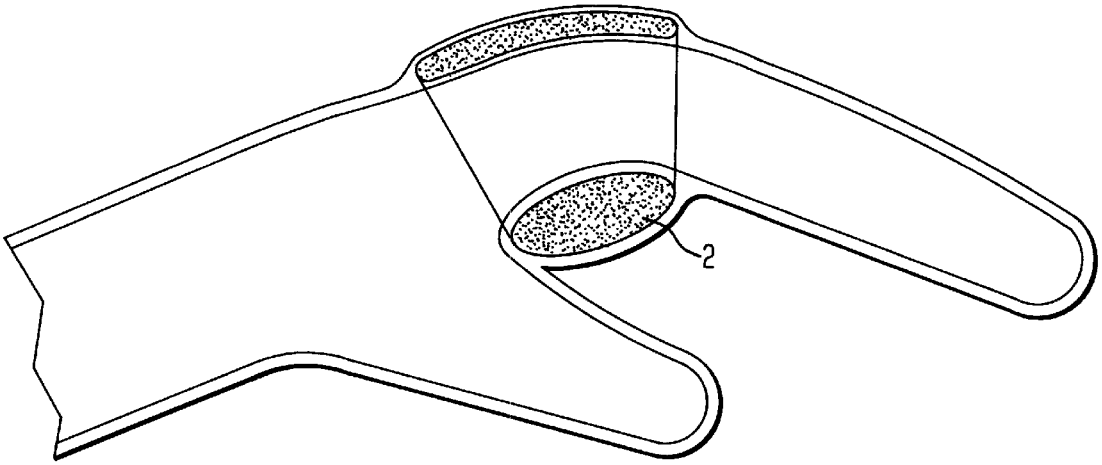
FIG. 3 shows a side view (a section) of a glove having a homogeneous gripping element and a knuckle protector.

FIG. 3 shows a similar embodiment example to the one in FIG. 2 with the difference that the gripping element 2 is homogeneous and oval in section. The gripping element 2 is preferably so shaped that its extension in the longitudinal direction of the hand (and the arm) is greater than the thickness of the element.

Figure 4:
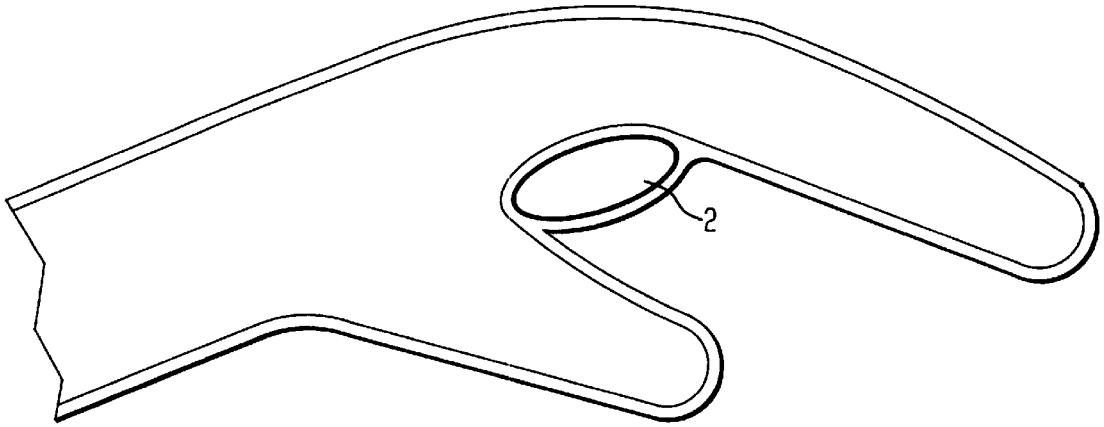
FIG. 4 shows a glove having a tube-shaped and oval gripping element.

FIG. 4 shows a tube-shaped and hollow gripping element 2 having an oval section.

Figure 5:
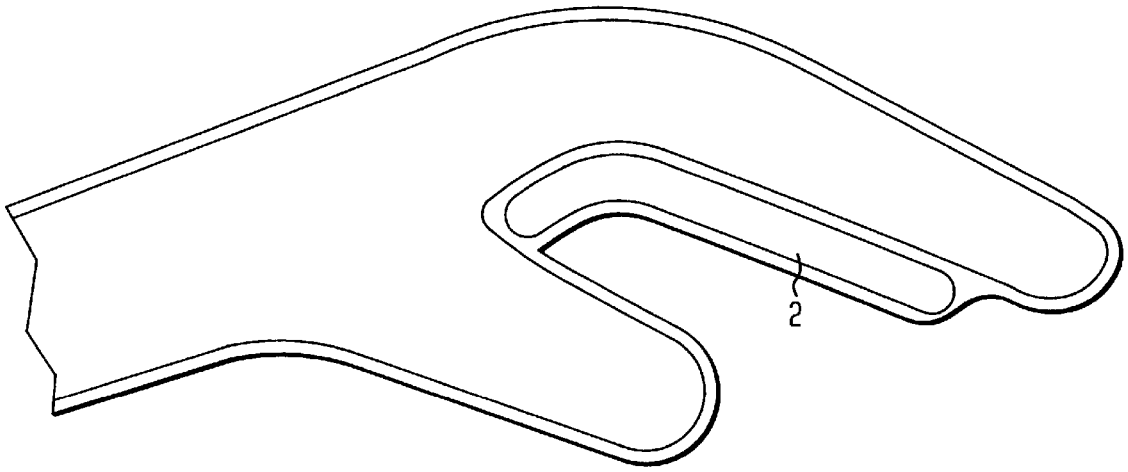
FIG. 5 shows a flat gripping element located at the palmar side of the glove and extending to the finger part.

FIG. 5 shows a flat gripping element 2 made preferably of a damping or bendable material such as neoprene. Laminated materials of different kinds such as, for example, Termosoft can of course also be used. The gripping element 2 is arranged at the palmar side of the glove and extends at least partly along the inner sides of the fingers and forms a more or less homogeneous tube when the hand is clenched.

Figure 6:
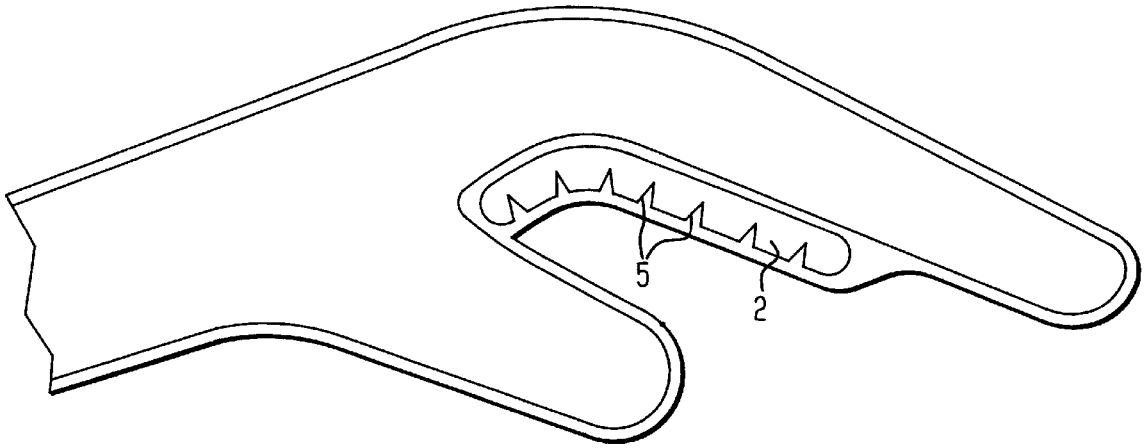
FIG. 6 shows a flat gripping element provided with, for instance, crossing slots to facilitate bending.

FIG. 6 shows another embodiment example of the flat gripping element according to FIG. 5. This gripping element 2, which can be made from a harder and accordingly less compressible material, is here provided with transverse slots to facilitate bending and at the same time to obtain a stiffening when a sufficient bending has been obtained.

Figure 7:
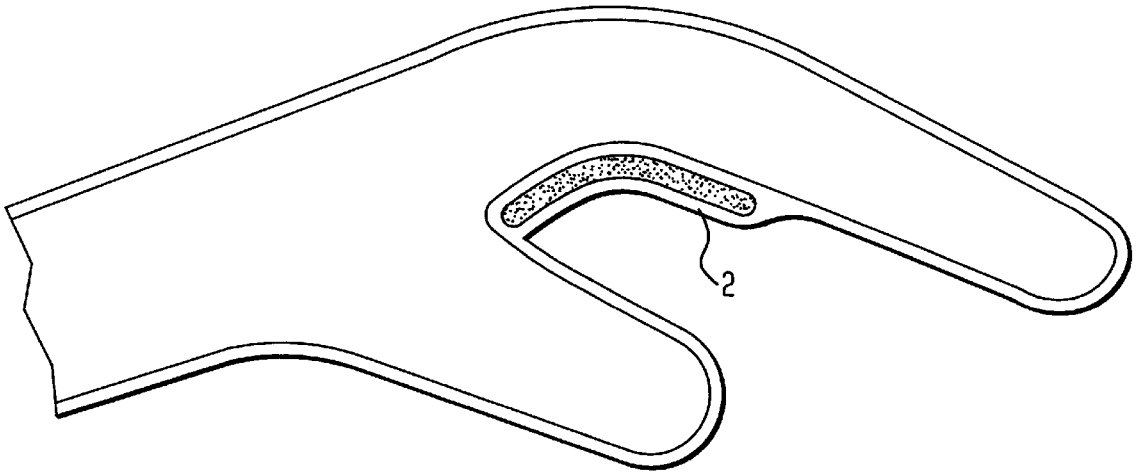
FIG. 7 shows a further example of a flat gripping element of a flexible material inserted in a glove.

FIG. 7 shows a flat gripping element 2 having a lesser extension in the hand/glove than what is the case in FIG. 5 or 6. A still greater freedom of movement and comfort for the user is hereby obtained. The thickness of the gripping element can of course be adjusted depending on the desired effect.

Figure 8:
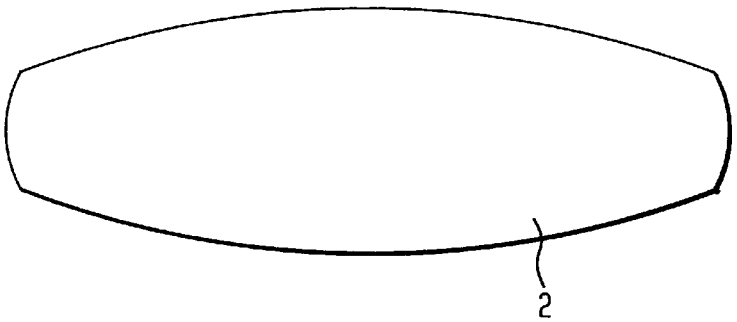
FIG. 8 shows a gripping element having a cross section which decreases outwardly towards the ends.

FIG. 8 shows a side view of a gripping element 2 which is substantially spoon-shaped and the diameter of which decreases towards its end. This embodiment results in an advantageous load on the different bones of the hand.

Figure 9:
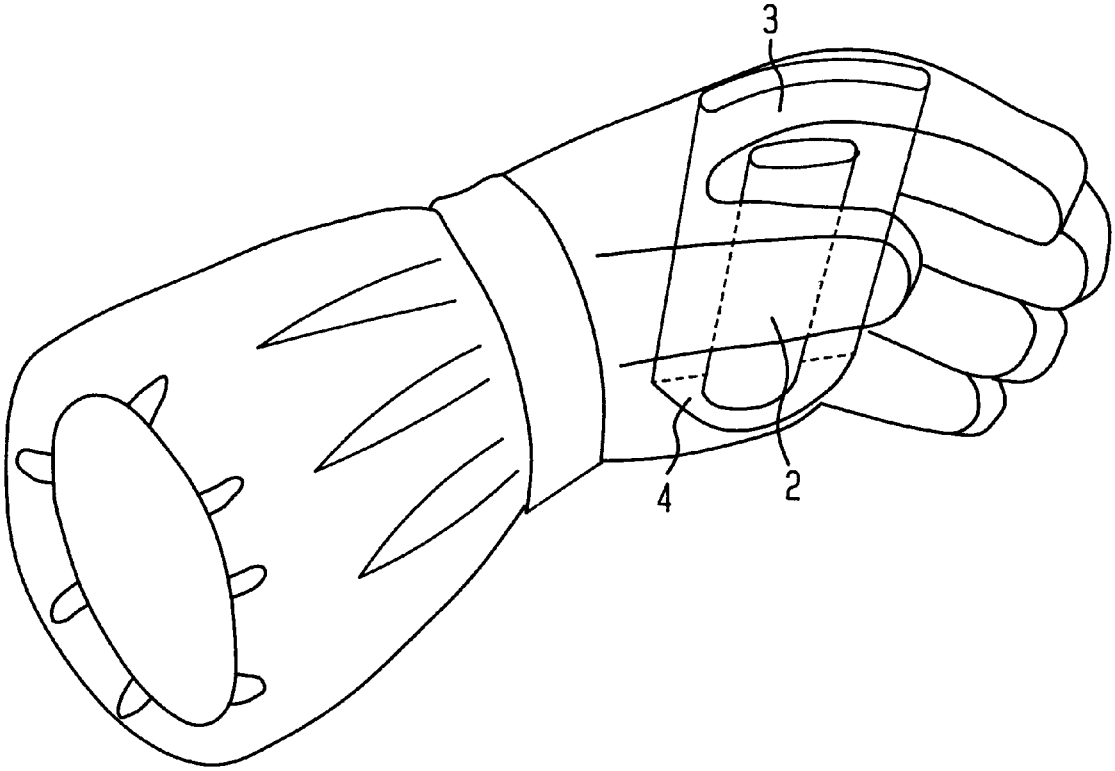
FIG. 9 shows a glove corresponding to FIG. 1 but with only one side support arranged.

FIG. 9 shows a glove similar to the one which is shown in FIG. 2 but with the difference that only one side support 4 is arranged. This side support 4 connects the gripping element 2 and the knuckle protector 3 with each other. The side support 4 may consist of a part of the knuckle protector 3 which is bent around the ulnar side of the hand and to which the gripping element 2 is fastened by means of, for instance, a glue connection or the like. Thus, inter alia, the advantage is obtained that the ulnar side of the hand and the small bones therein are protected against injuries of impact and the like in that the forces are partly dampened by the stuffing and partly distributed in the gripping element 2 to the other fingers.

Figure 10:
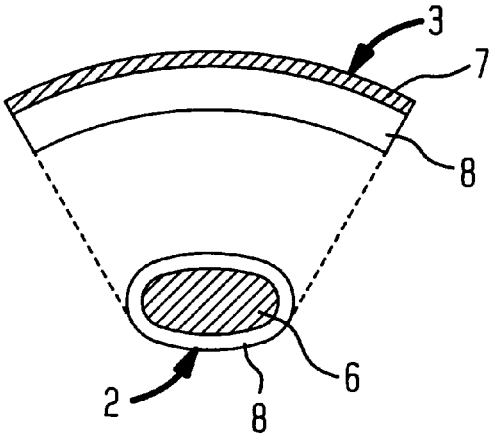
FIGS. 10 and 11 show in section the gripping element and knuckle protector in FIG. 9.

FIG. 10 shows a section through the gripping element 2 and the knuckle protector 3 according to FIG. 9, wherein it is shown how these parts can be formed. The gripping element 2 can, for instance, as here, consist of a harder core 6 and a thinner layer of a softer stuffing material, for instance neoprene, arranged around the core. The knuckle protector 3, which can be arched to better suit the hand while in use, is advantageously formed with an outer hard shell 7, for example of cured plastics, glass fibre-reinforced polymer, metal, or the like and with a softer lower layer 8 as stuffing, for example neoprene, to improve the comfort of the user. The hand is protected against impacts of sharp articles or the like by the harder outer shell 7.

Figure 11:
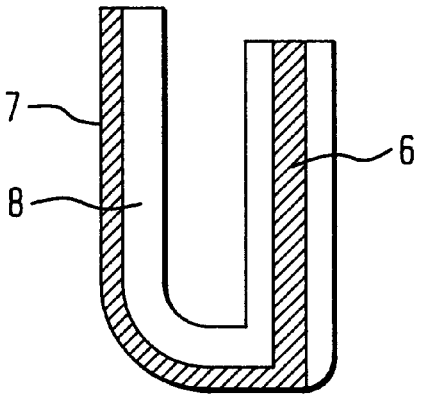

FIG. 11 shows an axial section through the knuckle protector 3 and the gripping element 2 whereby it is shown that the outer hard shell 7 and the hard core 6 of the gripping element 2 are united into an integrated unit to make a stable unit the function of which is to receive knocks against the hand and distribute these. The ulnar side, which is especially subjected to knocks, for instance when falling forward with a clenched hand, is protected by the fact that also the uniting parts between the gripping element 2 and the shell 7 on their inner side are provided with stuffing.

Figure 12:
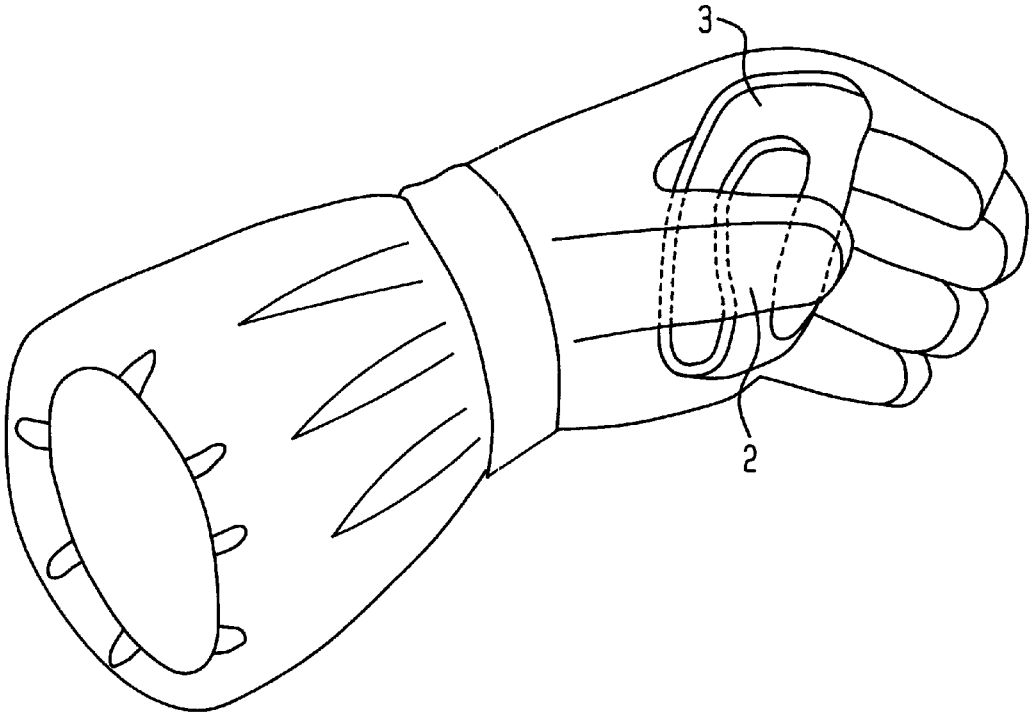
FIG. 12 shows a protection device with gripping element and knuckle protector in one unit.

FIG. 12 shows an integrated knuckle protector 3 and gripping element 2 similar to the one in FIG. 9 with the difference that the gripping element 2 and the knuckle protector 3 are produced, for example moulded or extruded, in one piece from a homogeneous material. A greater freedom to form the protecting device independent of the anatomy of the hand is thereby provided.

Figure 13:
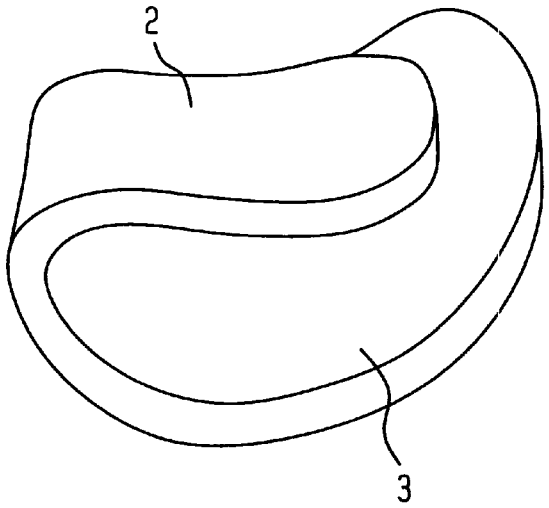
FIG. 13 shows a perspective view of the protection device according to FIG. 12.

FIG. 13 shows the integrated protection according to FIG. 12 shaped in one piece and cut out from, for instance, a disc of neoprene and bent so that it will suit an imagined hand form.

Figure 14:
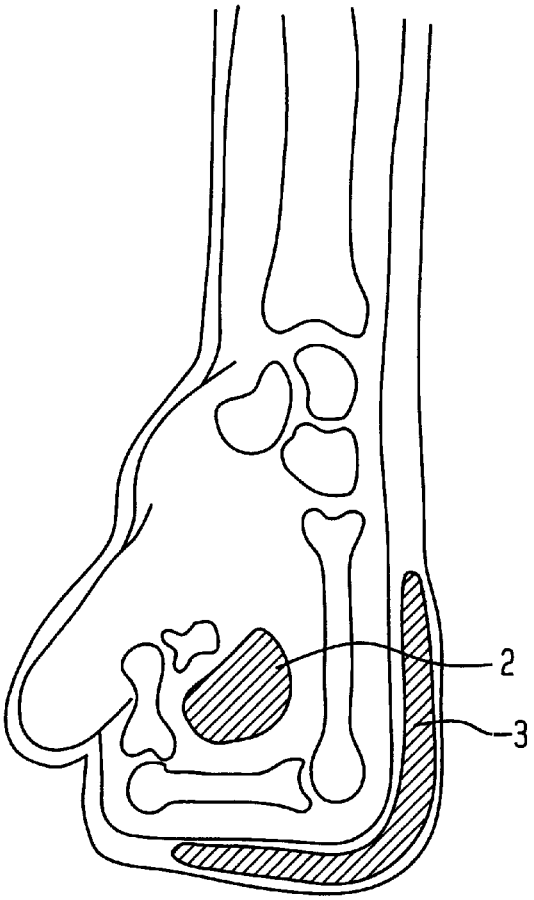
FIG. 14 shows in section a clenched hand in a glove provided with a protection device with knuckle protector and gripping element according to the invention.

FIG. 14 shows a section of a glove according to the invention and a hand therein the bones of which are visible. The knuckle protector 3 is here so placed that it follows the outer side of the hand around the knuckles and in the middle of the hand the fingers are bent around a gripping element 2 here formed in sections as a semi-circle.

Figure 16:
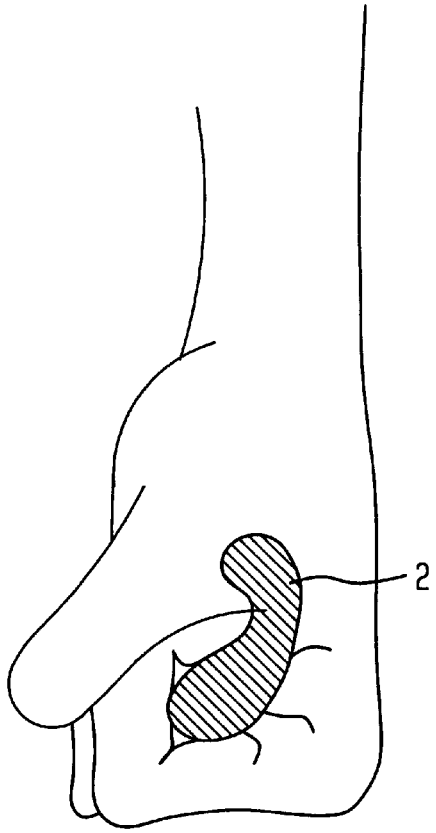
FIGS. 15 and 16 show further embodiments of the gripping element.
Figure 15:
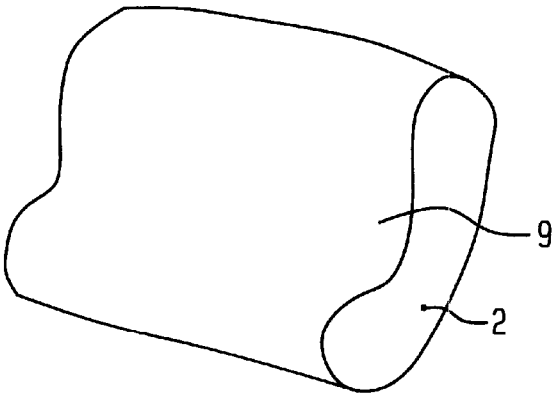

FIGS. 15 and 16 show another embodiment of the gripping element 2 where the main form can be described as oval having a recess 9 on one side. Thus, two bulges are made and the recess 9 is formed to facilitate the bending in of the outer parts of the fingers, which enhances the comfort. This form also makes it easier for the user to grip around other articles such as ski poles, snow boards and the like.

Figure 17:
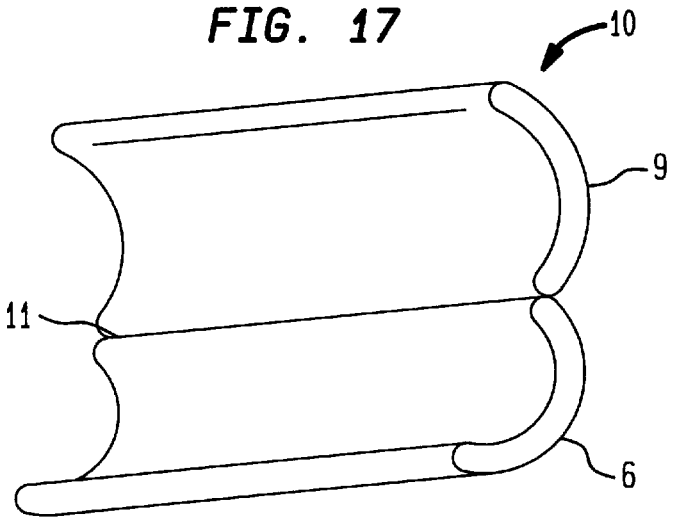
FIGS. 17, 18 show a protection device including an and 19 openable gripping element.

FIG. 17 shows a grip element 2 of a preferably hard material which has the shape of a dissected cylinder 10 provided with a hinge 11 along one of the cutting lines. The hinge 11 may be omitted if the parts 10*a, b* are placed in pockets therefor (not shown) arranged close to each other in the glove. Through this embodiment the gripping element 2 occupies a small space when the hand is not closed, which allows greater freedom to grip other articles.

Figure 18:
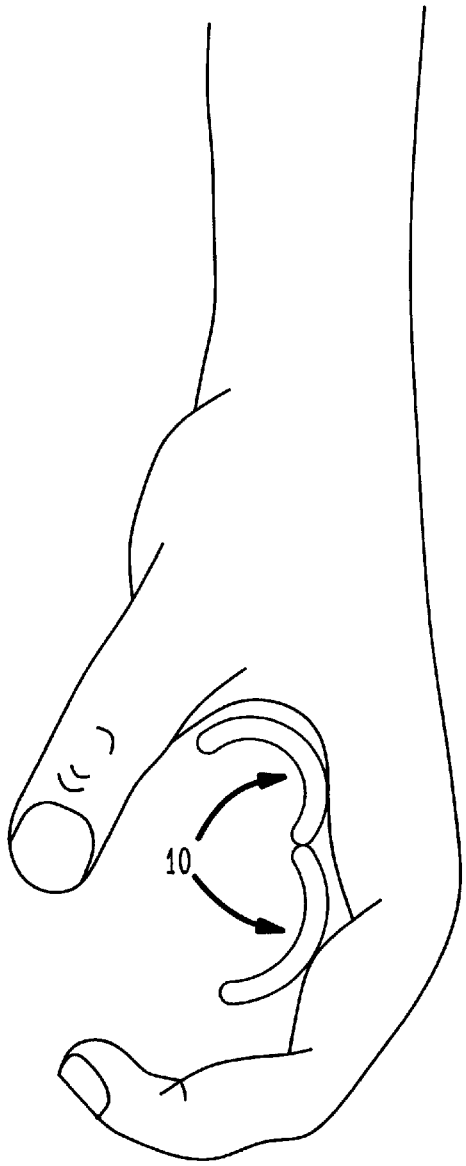
Figure 19:
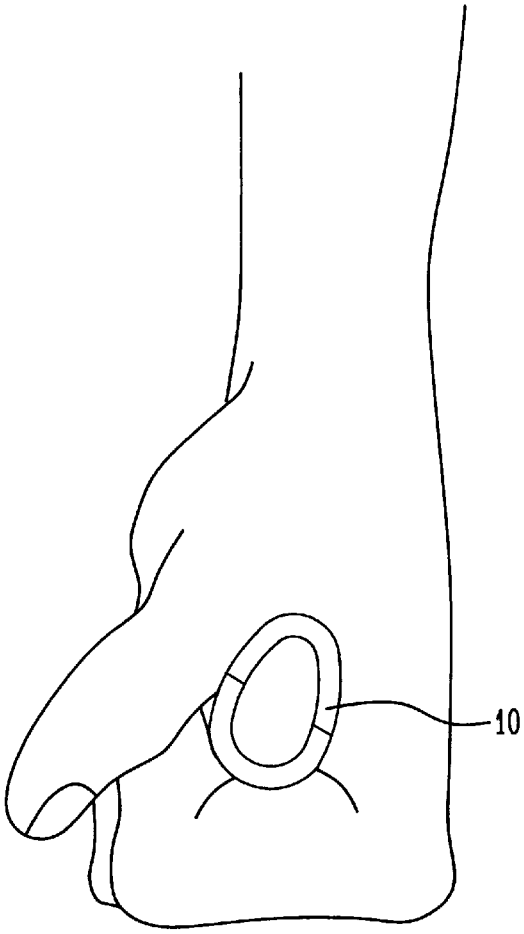
Figure 21:
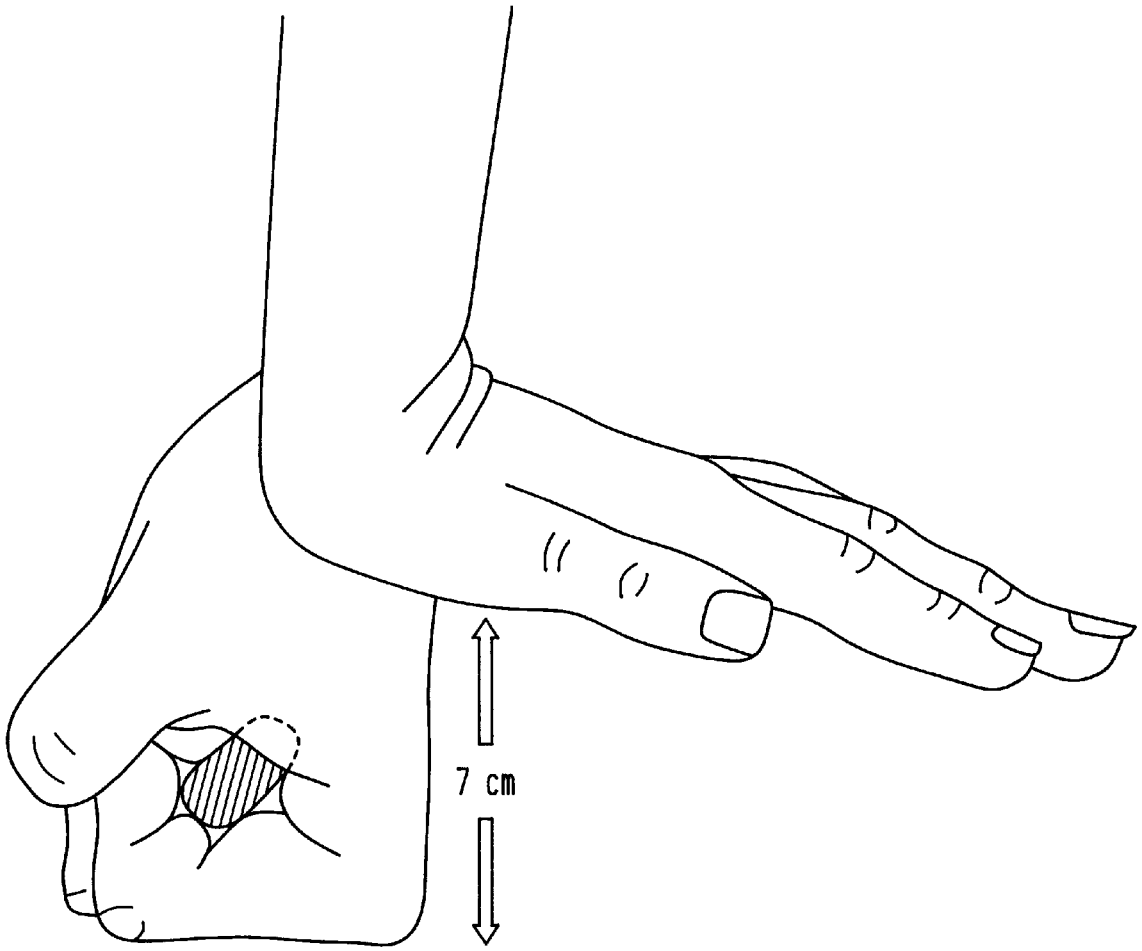
FIG. 21 shows in section a hand with a fist and with the wrist bent backwards.

FIGS. 18 and 19 show the gripping element 2 according to FIG. 17 when used both in an open hand and in a closed hand.

Figure 20:
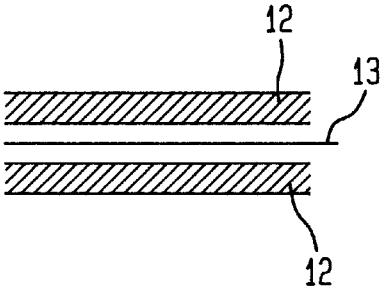
FIG. 20 shows a section through a part of a protection device.

In FIG. 20 it is shown how the gripping element 2 or the knuckle protector 3 can be formed to further increase the comfort of the glove. To increase the flexibility, the protection is manufactured with several stuffing layers 12 which are allowed to glide against each other on bending. This can be brought about by placing the layers 12 in pockets in the glove with, for example, one or more layer 13 of cloth, foil or webs 13 between each stuffing layer 12. Alternatively, every stuffing layer 12 can itself have a surface which enables gliding against neighbouring material.

The gripping elements 2 can, as mentioned above, be sewn in the glove 1 in, for instance, pockets arranged on an inner glove, but they can also be placed loosely within the glove. It is also conceivable to have a completely loose gripping element 2 outside the glove and arrange this when needed on the exterior of the glove 1 (on the palmar side) by means of a fastening arrangement which may consist of, for example, a hook and loop attachment, elastic band or the like (not shown). A further possibility is to arrange the gripping element 2 to be pivotable, foldable or releasable on the glove in such a way that it can be brought into place when needed by the user. The protection arrangement can also, as shown for example in FIG. 13, work as a clamp which can be placed directly on the hand or outside the glove. The protection device can also be formed to enclose the hand/glove.

The invention is not limited to the embodiment examples described but can be varied within the scope of the claims.

What is claimed is:

1. A protective device intended to reduce the risk and effects of hand and arm injuries comprising a gripping element mounted adjacent to the palm of a user's hand for inducing the user to clench the hand around said gripping element during falling, said gripping element comprising a plurality of layers of damping material for slidable movement with respect to each other upon bending forces being exerted thereon and being dimensioned such that when the user grips the gripping element the muscles of the user's forearm are caused to contract in a manner so as to obtain superimposing of the actin and myosin fibrils in order to increase the strength of the user's skeleton and substantially reduce the risk of injuries thereto.

2. The protective device of claim 1 wherein said gripping element comprises substantially rigid material.

3. The protective device of claim 1 including a knuckle protector covering the outer side of the user's hand.

4. The protective device of claim 3 wherein said gripping element and said knuckle protector are integral with each other.

5. The protective device of claim 3 wherein said knuckle protector comprises a plurality of layers of damping material for slidable movement with respect to each other upon bending forces being exerted thereon.

6. The protective device of claim 3 including a side support arranged between said gripping element and said knuckle protector at the ulnar side of said user's hand.

7. The protective device of claim 3 wherein said knuckle protector comprises an outer hard shell.

8. A protective device intended to reduce the risk and effects of hand and arm injuries comprising a gripping element mounted adjacent to the palm of a user's hand for inducing the user to clench the hand around said gripping element during falling, said gripping element being dimensioned such that when the user grips the gripping element the muscles of the user's forearm are caused to contract in a manner so as to obtain superimposing of the actin and myosin fibrils in order to increase the strength of the user's skeleton and substantially reduce the risk of injuries thereto, and including a knuckle protector covering the outer side of the user's hand, said knuckle protector comprising a plurality of layers of damping material for slidable movement with respect to each other upon bending forces being exerted thereon.

9. A protective device intended to reduce the risk and effects of hand and arm injuries comprising a gripping element mounted adjacent to the palm of a user's hand for inducing the user to clench the hand around said gripping element during falling, said gripping element being dimensioned such that when the user grips the gripping element the muscles of the user's forearm are caused to contract in a manner so as to obtain superimposing of the actin and myosin fibrils in order to increase the strength of the user's skeleton and substantially reduce the risk of injuries thereto, and including a knuckle protector covering the outer side of the user's hand, said knuckle protector comprising an outer hard shell.

10. The protective device as claimed in any of claims 1–9 wherein said gripping element comprises at least in part flexible material.

11. A glove intended to reduce the risk and effects of hand and arm injuries comprising a gripping element comprising substantially rigid material integrated into the palm of a user's hand in a manner such that said gripping element remains in position without being held by the user's hand for inducing the user to clench the hand around said gripping element during falling, said gripping element having a sufficient size so as to provide squeezing resistance to the creation of a fist and such that when the user grips the gripping element the muscles of the user's forearm are caused to contract in a manner so as to obtain superimposing of the actin and myosin fibrils in order to increase the strength of the user's skeleton and substantially reduce the risk of injuries thereto.

12. A glove intended to reduce the risk and effects of hand and arm injuries comprising a gripping element comprising a plurality of layers of damping material for slidable movement with respect to each other upon bending forces being exerted thereon integrated into the palm of a user's hand in a manner such that said gripping element remains in position without being held by the user's hand for inducing the user to clench the hand around said gripping element during falling, said gripping element having a sufficient size so as to provide squeezing resistance to the creation of a fist and such that when the user grips the gripping element the muscles of the user's forearm are caused to contract in a manner so as to obtain superimposing of the actin and myosin fibrils in order to increase the strength of the user's skeleton and substantially reduce the risk of injuries thereto.

13. The glove as claimed in any of claims 11–12, including a knuckle protector covering the outer side of the user's hand.

14. The glove as claimed in claim 13, wherein said gripping element and said knuckle protector are integral with each other.

15. The glove as claimed in claim 13, wherein said knuckle protector comprises a plurality of layers of damping material for slidable movement with respect to each other upon bending forces being exerted thereon.

16. The glove as claimed in claim 13, including a side support arranged between said gripping element and said knuckle protector at the ulnar side of the user's hand.

17. The glove as claimed in claim 13, wherein said knuckle protector comprises an outer hard shell.

18. A glove intended to reduce the risk and effects of hand and arm injuries comprising a gripping element integrated into the palm of a user's hand in a manner such that said gripping element remains in position without being held by the user's hand for inducing the user to clench the hand around said gripping element during falling, said gripping element having a sufficient size so as to provide squeezing resistance to the creation of a fist and such that when the user grips the gripping element the muscles of the user's forearm are caused to contract in a manner so as to obtain superimposing of the actin and myosin fibrils in order to increase the strength of the user's skeleton and substantially reduce the risk of injuries thereto, and a knuckle protector covering the outer side of the user's hand, said knuckle protector comprising a plurality layers of damping material for slidable movement with respect to each other upon bending forces being exerted thereon.

19. A glove intended to reduce the risk and effects of hand and arm injuries comprising a gripping element integrated into the palm of a user's hand in a manner such that said gripping element remains in position without being held by the user's hand for inducing the user to clench the hand around said gripping element during falling, said gripping element having a sufficient size so as to provide squeezing resistance to the creation of a fist and such that when the user grips the gripping element the muscles of the user's forearm are caused to contract in a manner so as to obtain superimposing of the actin and myosin fibrils in order to increase the strength of the user's skeleton and substantially reduce the risk of injuries thereto, and a knuckle protector covering the outer side of the user's hand, said knuckle protector comprising an outer hard shell.

20. The glove as claimed in any of claims 11–19, wherein said gripping element comprises at least in part flexible material.

21. The glove as claimed in any of claims 11–19, wherein said gripping element comprises substantially rigid material.

22. The glove as claimed in any of claims 11–19, wherein said gripping element comprises a plurality of layers of damping material for slidable movement with respect to each other upon bending forces being exerted thereon.

* * * * *

UNITED STATES PATENT AND TRADEMARK OFFICE
CERTIFICATE OF CORRECTION

PATENT NO. : 6,154,882

DATED : December 5, 2000

INVENTOR(S) : Ullman

It is certified that error appears in the above-identified patent and that said Letters Patent is hereby corrected as shown below:

Column 3, line 3, following "18", insert --and 19--; after "an" delete "and".
Column 3, line 4, delete "19".

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*